US009341393B2

(12) United States Patent
Takayama et al.

(10) Patent No.: US 9,341,393 B2
(45) Date of Patent: May 17, 2016

(54) REFRIGERATING CYCLE APPARATUS HAVING AN INJECTION CIRCUIT AND OPERATING WITH REFRIGERANT IN SUPERCRITICAL STATE

(75) Inventors: Keisuke Takayama, Tokyo (JP); Yusuke Shimazu, Tokyo (JP); Takeshi Hatomura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 889 days.

(21) Appl. No.: 13/634,562

(22) PCT Filed: Apr. 27, 2010

(86) PCT No.: PCT/JP2010/003017

§ 371 (c)(1),
(2), (4) Date: Sep. 13, 2012

(87) PCT Pub. No.: WO2011/135616

PCT Pub. Date: Nov. 3, 2011

(65) Prior Publication Data

US 2013/0000340 A1 Jan. 3, 2013

(51) Int. Cl.

| | |
|---|---|
| ***F25B 9/00*** | (2006.01) |
| *F25B 49/02* | (2006.01) |
| *F25B 1/10* | (2006.01) |

(52) U.S. Cl.

CPC . *F25B 9/008* (2013.01); *F25B 1/10* (2013.01); *F25B 49/027* (2013.01); *F25B 2309/061* (2013.01); *F25B 2400/0409* (2013.01); *F25B 2400/13* (2013.01); *F25B 2500/07* (2013.01); *F25B 2500/08* (2013.01); *F25B 2600/17* (2013.01); *F25B 2600/2509* (2013.01);

(Continued)

(58) Field of Classification Search

CPC ..... F25B 1/10; F25B 6/02; F25B 9/008; F25B 49/027; F25B 2309/06; F25B 2309/061; F25B 2400/13; F25B 2400/0409; F25B 2400/0411; F25B 2500/07; F25B 2500/08; F25B 2600/17; F25B 2600/2501; F25B 2600/2509

See application file for complete search history.

(56) References Cited

U.S. PATENT DOCUMENTS

| | | | | |
|---|---|---|---|---|
| 6,418,735 | B1 * | 7/2002 | Sienel | 62/115 |
| 2004/0250568 | A1 | 12/2004 | Sienel | |

(Continued)

FOREIGN PATENT DOCUMENTS

| | | | |
|---|---|---|---|
| JP | 04-006372 | A | 1/1992 |
| JP | 10-288411 | A | 10/1998 |

(Continued)

OTHER PUBLICATIONS

Extended European Search Report dated Aug. 5, 2014 issued in corresponding EP patent application No. 10850639.5.

(Continued)

*Primary Examiner* — Jonathan Bradford
(74) *Attorney, Agent, or Firm* — Posz Law Group, PLC

(57) ABSTRACT

A refrigeration cycle apparatus increases the cooling capacity even under overload conditions in a refrigeration cycle apparatus that uses a refrigerant which undergoes transition to a supercritical state and in which the high-pressure side enters a supercritical state.

A refrigeration cycle apparatus adjusts a high-pressure-side pressure of a refrigerant flowing through a main refrigerant circuit by causing a controller to control an opening degree of a second expansion valve and a heat transfer area of a radiator.

13 Claims, 6 Drawing Sheets

(52) U.S. Cl.
CPC ... *F25B2700/195* (2013.01); *F25B 2700/1931* (2013.01); *F25B 2700/1933* (2013.01); *F25B 2700/21151* (2013.01); *F25B 2700/21152* (2013.01)

(56) References Cited

U.S. PATENT DOCUMENTS

| | | | | |
|---|---|---|---|---|
| 2006/0191288 | A1* | 8/2006 | Radermacher et al. | 62/510 |
| 2008/0041094 | A1 | 2/2008 | Sienel | |

FOREIGN PATENT DOCUMENTS

| | | | |
|---|---|---|---|
| JP | 2005-164103 | A | 6/2005 |
| JP | 2007-503571 | A | 2/2007 |
| JP | 2007-170683 | A | 7/2007 |
| JP | 4207235 | B2 | 10/2008 |
| JP | 2010-091135 | A | 4/2010 |
| WO | 2008/130358 | A1 | 10/2008 |

OTHER PUBLICATIONS

Office Action mailed on Mar. 18, 2014 in corresponding CN Application No. 201080066443.0 (English Translation).

International Search Report mailed on Jul. 6, 2010 for the corresponding International patent application No. PCT/JP2010/003017.

* cited by examiner

REFRIGERATING CYCLE APPARATUS HAVING AN INJECTION CIRCUIT AND OPERATING WITH REFRIGERANT IN SUPERCRITICAL STATE

CROSS REFERENCE TO RELATED APPLICATION

This application is a U.S. national stage application of PCT/JP2010/003017 filed on Apr. 27, 2010.

TECHNICAL FIELD

The present invention generally relates to refrigeration cycle apparatuses using a refrigerant that undergoes transition into a supercritical state, and particularly relates to a refrigeration cycle apparatus having an injection circuit.

BACKGROUND ART

As known vapor compression refrigeration cycles that use a refrigerant such as carbon dioxide ($CO_2$) in its supercritical region, there is a vapor compression refrigeration cycle in which a refrigerant that has flowed out of a radiator is branched such that one portion of the refrigerant is subjected to pressure reduction in a pressure reducing device, flows through a cooler so as to exchange heat with the other portion of the refrigerant that has flowed out of the radiator, and is injected in the middle of a compression stroke of a compressor (see Patent Literature 1, for example). The vapor compression refrigeration cycle disclosed in Patent Literature 1 increases the refrigeration capacity by reducing the specific enthalpy of the other portion of the refrigerant. Further, the pressure reducing device is configured to increase the opening degree thereof when the degree of superheat of the one portion of the refrigerant at the outlet of the cooler is higher than a predetermined degree of superheat.

CITATION LIST

Patent Literature

Patent Literature 1: Japanese Patent No. 4207235 (Claim 1, FIG. 1)

SUMMARY OF INVENTION

Technical Problem

However, the known vapor compression refrigeration cycle has the following problem.

Under overload conditions where inlet air temperatures of the radiator and an evaporator become high, a high-pressure-side pressure and a low-pressure-side pressure become high. As a result, the pressure of one of the refrigerant that has been branched from the radiator and has been subjected to pressure reduction also becomes high, and may enter a supercritical state. In a vapor compression refrigeration cycle as described in Patent Literature 1, under overload conditions, the degree of superheat of the one portion of the refrigerant at the outlet of the cooler cannot be calculated, which may make it impossible to control the specific enthalpy of the other portion of the refrigerant. Further, if the one portion of the refrigerant is in a supercritical state, no latent heat change occurs during the heating process of the refrigerant, and therefore effect of cooling the other portion of the refrigerant in the cooler cannot be expected much.

The invention has been made to overcome the above problem and an object thereof is to provide a refrigeration cycle apparatus that is capable of increasing the cooling capacity even under overload conditions in a refrigeration cycle apparatus that uses a refrigerant which undergoes transition to a supercritical state and in which the high-pressure side enters a supercritical state.

Solution to Problem

A refrigeration cycle apparatus according to the invention includes a main refrigerant circuit in which a compressor that compresses a refrigerant, a radiator that rejects heat of the refrigerant compressed by the compressor, a primary passage of an internal heat exchanger that exchanges heat between the refrigerant which has passed through the radiator and the refrigerant which has passed through the radiator and is to be injected into the compressor, a first pressure reducing device that reduces a pressure of the refrigerant which has passed through the primary passage of the internal heat exchanger, and an evaporator where the refrigerant that has been subjected to pressure reduction by the first pressure reducing device evaporates are sequentially connected to one another by pipes; an injection circuit in which a second pressure reducing device that reduces a pressure of the refrigerant which has passed through the radiator and is to be injected into the compressor, a secondary passage of the internal heat exchanger, and an injection port of the compressor are sequentially connected to one another by pipes; and a controller that adjusts a high-pressure-side pressure of the refrigerant flowing through the main refrigerant circuit by controlling an opening degree of the second pressure reducing device and a heat transfer area of the radiator.

Advantageous Effects of Invention

A refrigeration cycle apparatus according to the invention can adjust a high-pressure-side pressure of a refrigerant flowing through a main refrigerant circuit by controlling an opening degree of a second pressure reducing device and a heat transfer area of a radiator. Therefore, even under operational conditions where a cooling operation is performed under overload conditions and an intermediate pressure becomes supercritical, for example, the refrigeration cycle apparatus can reliably increase the high-pressure-side pressure, and thereby can increase the cooling capacity.

DESCRIPTION OF EMBODIMENTS

Embodiments of the invention will be described below with reference to the drawings.

Embodiment 1

Figure 1:
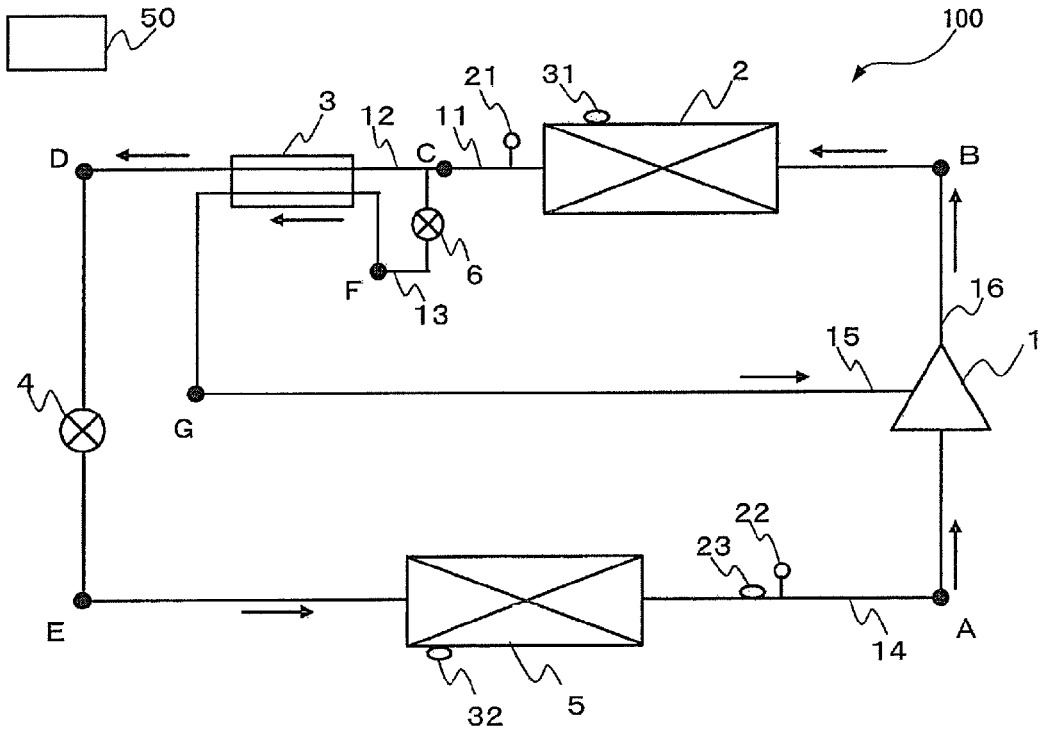
FIG. 1 is a circuit diagram schematically showing a configuration of a refrigerant circuit of a refrigeration cycle apparatus according to Embodiment 1 of the invention.
Figure 2:
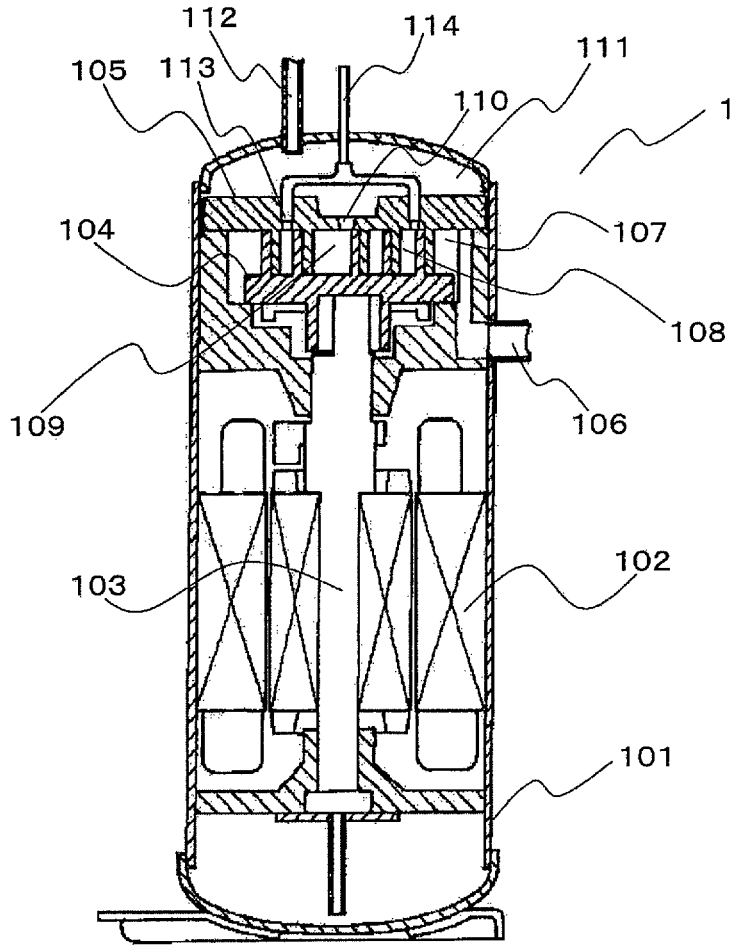
FIG. 2 is a schematic vertical cross-sectional view showing a cross-sectional configuration of a compressor.
Figure 3:
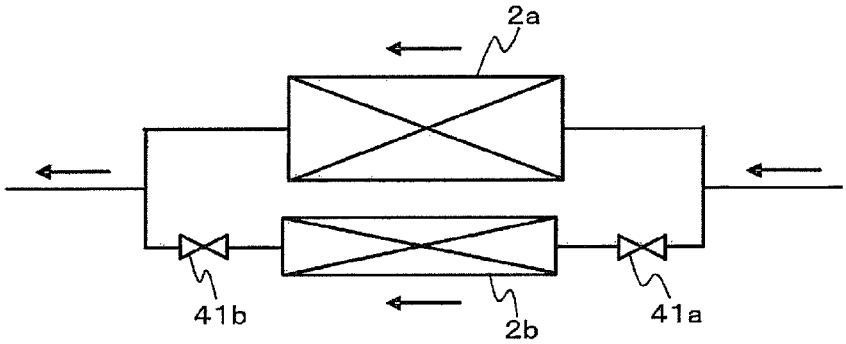
FIG. 3 is a diagram illustrating an exemplary embodiment of a radiator.
Figure 4:
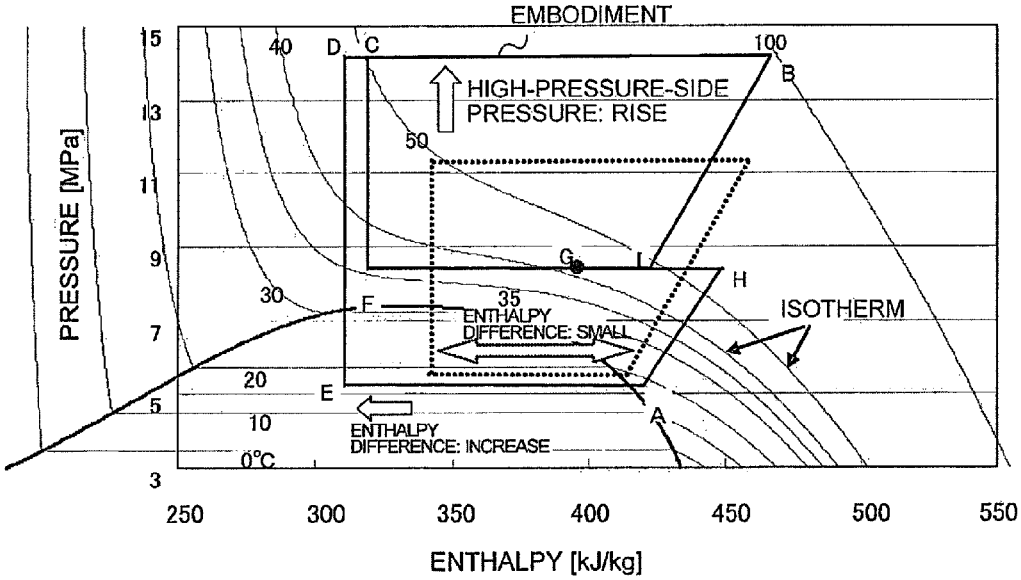
FIG. 4 is a P-h diagram showing transition of a refrigerant during a cooling operation of the refrigeration cycle apparatus according to Embodiment 1 of the invention.

FIG. 1 is a circuit diagram schematically showing a configuration of a refrigerant circuit of a refrigeration cycle apparatus 100 according to Embodiment 1 of the invention. FIG. 2 is a schematic vertical cross-sectional view showing a cross-sectional configuration of a compressor 1. FIG. 3 is a diagram illustrating an exemplary embodiment of a radiator 2. FIG. 4 is a P-h diagram showing transition of a refrigerant during a cooling operation of the refrigeration cycle apparatus 100. The circuit configuration and operations of the refrigeration cycle apparatus 100 will be described with reference to FIGS. 1 through 4.

The refrigeration cycle apparatus 100 of this embodiment is used as a device having a refrigeration cycle for circulating a refrigerant, such as a refrigerator, a freezer, an automatic vending machine, an air-conditioning device (e.g., air-conditioning devices for home and industrial uses, and for vehicles), and a water heater. In particular, great advantages are enjoyed in a refrigeration cycle apparatus using a refrigerant that enters a supercritical state on a high-pressure side. It should be noted that the dimensional relationships of components in FIG. 1 and other subsequent drawings may be different from the actual ones. Also, in FIG. 1 and other subsequent drawings, components applied with the same reference signs correspond to the same or equivalent components. This is common through the full text of the description. Further, forms of components described in the full text of the description are mere examples, and the components are not limited to the described forms of components.

The refrigeration cycle apparatus 100 includes at least the compressor 1, the radiator 2, an internal heat exchanger 3, a first expansion valve 4 serving as a pressure reducing device, an evaporator 5, and a second expansion valve serving as a pressure reducing device. The compressor 1, the radiator 2, a primary passage of the internal heat exchanger 3, the first expansion valve 4, and the evaporator 5 are connected to one another by pipes so as to form a main refrigerant circuit. Also, the compressor 1, the radiator 2, a second expansion valve 6, a secondary passage of the internal heat exchanger 3, and an injection port 113 of the compressor 1 are connected to one another by pipes so as to form an injection circuit. Further, the refrigeration cycle apparatus 100 includes a controller 50 that controls the overall control of the refrigeration cycle apparatus 100.

In Embodiment 1, it is assumed that the refrigeration cycle apparatus 100 uses carbon dioxide ($CO_2$) as a refrigerant. Carbon dioxide has characteristics such as zero ozone depleting potential and a small global warming potential as compared with conventional chlorofluorocarbon based refrigerants. However, the refrigerant is not limited to carbon dioxide, and other single refrigerants, mixed refrigerants (for example, a mixed refrigerant of carbon dioxide and diethyl ether), or the like that undergoes transition to a supercritical state may be used as the refrigerant.

The compressor 1 compresses the refrigerant, which is suctioned by an electric motor 102 and a drive shaft 103 driven by the electric motor 102, and turns the refrigerant into a high-temperature high-pressure state. This compressor 1 may preferably include a capacity-controllable inverter compressor, for example. It is to be noted that the details of the compressor 1 is described later with reference to FIG. 2.

The radiator 2 is configured to exchange heat between the refrigerant flowing through the main refrigerant circuit and a heat medium (e.g., air and water) such that the refrigerant transfers its heat to the heat medium. The radiator 2 exchanges heat between the air supplied by an air-sending device (not shown) and the refrigerant, for example. This radiator 2 includes a heat transfer pipe and a fin (not shown) for providing an increased heat transfer area between the refrigerant flowing through the heat transfer pipe and air, and exchanges heat between the refrigerant and air (outdoor air) so as to serve as a condenser or a gas cooler. In some cases, the radiator 2 may not completely gasify or vaporize the refrigerant, and may turn the refrigerant into a two-phase mixture of gas and liquid (two-phase gas-liquid refrigerant).

Further, as shown in FIG. 3, the radiator 2 may be divided into a first radiator 2*a* and a second radiator 2*b* such that the refrigerant is divided into portions that flow in parallel through the respective first radiator 2*a* and second radiator 2*b*. A solenoid valve 41*a* and a solenoid valve 41*b* serving as opening and closing devices may be provided at a refrigerant inlet and a refrigerant outlet, respectively, of one of the divided units of the radiator 2, namely, the second radiator 2*b*. With this configuration, the solenoid valve 41*a* and the solenoid valve 41*b* may be closed, if necessary, so as to block the refrigerant from flowing through the second radiator 2*b* and thereby to reduce the heat transfer area of the radiator 2. It should be noted that although FIG. 3 illustrates an example in which the radiator 2 is divided into two units, the radiator 2 may be divided into three or more units.

The internal heat exchanger 3 is configured to exchange heat between a refrigerant (primary side) flowing through the main refrigerant circuit between the radiator 2 and the first expansion valve 4, and a refrigerant (secondary side) flowing through the injection circuit between the second expansion valve 6 and the injection port 113 of the compressor 1. The internal heat exchanger 3 has one refrigerant inlet connected to a pipe 13 through which one portion (secondary-side refrigerant) of the refrigerant that has been branched after flowing out of the radiator 2 flows, and has the other refrigerant inlet connected to a pipe 12 through which the other portion (primary-side refrigerant) that has been branched after flowing out of the radiator 2 flows. The second expansion valve 6 is provided in the pipe 13 so as to reduce the pressure of the one portion of the refrigerant flowing into the internal heat exchanger 3. Accordingly, the temperature of the secondary-side refrigerant becomes lower than that of the primary-side refrigerant, and hence the primary-side refrigerant is cooled and the secondary-side refrigerant is heated in the internal heat exchanger 3.

The first expansion valve 4 is configured to reduce the pressure of the refrigerant flowing through the main refrigerant circuit and expands the refrigerant, and may include a valve whose opening degree is variably controllable, such as an electronic expansion valve.

The evaporator 5 is configured to exchange heat between the refrigerant flowing through the main refrigerant circuit and a heat medium (e.g., air and water) such that the refrigerant receives heat from the heat medium. The radiator 2 is configured to exchange heat with the air supplied by an air-sending device (not shown) and the refrigerant, for example. This evaporator 5 includes a heat transfer pipe and a fin (not shown) for increasing the heat transfer area between the refrigerant flowing through the heat transfer pipe and air, and exchanges heat between the refrigerant and air (outdoor air) so as to evaporate and gasify (vaporize) the refrigerant.

The second expansion valve 6 is configured to reduce the pressure of the refrigerant flowing through the injection circuit and expands the refrigerant, and may include a valve whose opening degree is variably controllable, such as an electronic expansion valve.

Refrigerant pipes for connecting respective components in the main refrigerant circuit include a discharge pipe 16 of the compressor 1, a pipe 11 provided on a refrigerant outlet side of the radiator 2, the pipe 12 provided on a primary-side inlet of the internal heat exchanger 3, and a pipe 14 provided on a refrigerant outlet side of the evaporator 5. Refrigerant pipes in the injection circuit include the pipe 13 branched from the pipe 11 and connected to a secondary-side inlet of the internal heat exchanger 3, and a pipe 15 connecting a secondary-side outlet of the internal heat exchanger 3 to the injection port 113 of the compressor 1.

Further, the refrigeration cycle apparatus 100 includes a pressure sensor 21 serving as first pressure detecting means, a temperature sensor 31 serving as first temperature detecting means, a pressure sensor 22 serving as second pressure detecting means, a temperature sensor 23 serving as temperature detecting means, and a temperature sensor 32 serving as second temperature detecting means. Information (pressure information and temperature information) detected by these various detecting means is sent to the controller 50 so as to be used for controlling the components of the refrigeration cycle apparatus 100.

The pressure sensor 21 is provided in the pipe 11 at the refrigerant outlet of the radiator 2, and is configured to detect the refrigerant pressure on the refrigerant outlet side of the radiator 2. The temperature sensor 31 is provided in the vicinity of the radiator 2, such as the outer surface of the radiator 2, and is configured to detect the temperature of the heat medium, such as air, entering the radiator 2. The temperature sensor 31 may include a thermistor, for example. The pressure sensor 22 is provided in the pipe 14 at the refrigerant outlet of the evaporator 5, and is configured to detect the refrigerant pressure on the refrigerant outlet side of the evaporator 5. The temperature sensor 23 is provided in the pipe 14 at the refrigerant outlet of the evaporator 5, and is configured to detect the refrigerant temperature on the refrigerant outlet side of the evaporator 5. The temperature sensor 23 may include a thermistor, for example. The temperature sensor 32 is provided in the vicinity of the evaporator 5, such as the outer surface of the evaporator 5, and is configured to detect the temperature of the heat medium, such as air, entering the evaporator 5. The temperature sensor 32 may include a thermistor, for example.

It should be noted that the installation positions of the pressure sensor 21, the temperature sensor 31, the pressure sensor 22, the temperature sensor 23, and the temperature sensor 32 are not limited to the positions shown in FIG. 1, and these components may be installed in any positions where the pressure sensor 21, the temperature sensor 31, the pressure sensor 22, the temperature sensor 23, and the temperature sensor 32 can detect the pressure of the refrigerant that has flowed out of the radiator 2, the temperature of the heat medium entering the radiator 2, the pressure of the refrigerant that has flowed out of the evaporator 5, the temperature of the refrigerant that has flowed out of the evaporator 5, and the temperature of the heat medium entering the evaporator 5, respectively. Further, the controller 50 controls the drive frequency of the compressor 1, the rotational speed of the air-sending devices (not shown) provided in the vicinity of the radiator 2 and the evaporator 5, the opening degree of the first expansion valve 4, the opening degree of the second expansion valve 6, and opening and closing of the solenoid valves 41*a* and 41*b* if they are provided.

The configuration and operation of the compressor 1 will be described with reference to FIG. 2.

In the compressor 1, the electric motor 102 serving as the driving force, the drive shaft 103 configured to be rotated and driven by the electric motor 102, an oscillating scroll 104 attached to a distal end of the drive shaft 103 and configured to be rotated and driven together with the drive shaft 103, a fixed scroll 105 disposed above the oscillating scroll 104 and having a lap that engages a lap of the oscillating scroll 104, etc., are accommodated in a shell 101 constituting the outer wall of the compressor 1. Further, an inflow pipe 106 that allows the refrigerant to flow into the shell 101, an outflow pipe 112 connected to the discharge pipe 16, and an injection pipe 114 connected to the pipe 15 are connected to the shell 101.

In the shell 101, a low-pressure space 107 communicating with the inflow pipe 106 is formed at the outermost peripheries of the laps of the oscillating scroll 104 and the fixed scroll 105. A high-pressure space 111 communicating with the outflow pipe 112 is formed at the inner upper part of the shell 101. The lap of the oscillating scroll 104 and the lap of the fixed scroll engage with each other so as to form a plurality of compression chambers (e.g., a compression chamber 108 and a compression chamber 109) whose capacities vary relatively. The compression chamber 109 illustrates a compression chamber formed at substantially center portions of the oscillating scroll 104 and the fixed scroll 105. The compression chamber 108 illustrates a compression chamber formed during midway of a compression process, on the outer side of the compression chamber 109.

An outflow port 110 communicating between the compression chamber 109 and the high-pressure space 111 is provided substantially at the center of the fixed scroll 105. The injection port 113 communicating between the compression chamber 108 and the injection pipe 114 is provided at a midway position of the compression process of the fixed scroll 105. Further, an Oldham ring (not shown) for preventing rotation movement of the oscillating scroll 104 during eccentric turning movement is arranged in the shell 101. This Oldham ring provides the function of stopping the rotation movement and a function of allowing orbital motion of the oscillating scroll 104.

It should be noted that the fixed scroll 105 is fixed inside the shell 101. Also, the oscillating scroll 104 performs orbital motion relative to the fixed scroll 105 without performing the rotation movement. Further, the electric motor 102 includes at least a stator that is fixed inside the shell 101, and a rotor that is arranged so as to be rotatable inside an inner peripheral surface of the stator and that is fixed to the drive shaft 103. The stator has a function of rotatably driving the rotor when the stator is energized. The rotor has a function of being rotatably driven and rotating the drive shaft 103 when the stator is energized.

Operations of the compressor 1 will be described briefly.

When the electric motor 102 is energized, a torque is generated between the stator and the rotor constituting the electric motor 102, and the drive shaft 103 is rotated. The oscillating scroll 104 is mounted to the distal end of the drive shaft 103 such that the oscillating scroll 104 performs the orbital motion. The compression chamber moves toward the center while the volume of the compression chamber is reduced by the turning movement of the oscillating scroll 104, and hence the refrigerant is compressed.

The refrigerant flowing through the pipe 15 of the injection circuit flows into the compressor 1 through the injection pipe 114. Meanwhile, the refrigerant flowing through the pipe 14 flows into the compressor 1 through the inflow pipe 106. The refrigerant that has flowed from the inflow pipe 106 flows into the low-pressure space 107, and is trapped inside the compression chamber so at to be gradually compressed. Then, when the compression chamber reaches the compression chamber 108 at the midway position of the compression process, the refrigerant flows into the compression chamber 108 from the injection port 113.

That is, the refrigerant that has flowed in from the injection pipe 114 and the refrigerant that has flowed in from the inflow pipe 106 are mixed in the compression chamber 108. Then, the mixed refrigerant is gradually compressed and reaches the compression chamber 109. The refrigerant that has reached the compression chamber 109 passes through the outflow port 110 and the high-pressure space 111, is discharged outside the shell 101 through the outflow pipe 112, and passes through the discharge pipe 16.

Operation action of the refrigeration cycle apparatus 100 will be described with reference to FIG. 1 and FIG. 4. It should be noted that the symbols A through I shown in FIG. 1 correspond to the symbols A through I shown in FIG. 4. Here, the highs and lows of the pressures in the refrigerant circuit and the like of the refrigeration cycle apparatus 100 is not determined in relation to a reference pressure, but relative pressures as the result of an increase in pressure by the main compressor 1 and a reduction in pressure by the first expansion valve 4 and the second expansion valve 6 are respectively expressed as a high pressure and a low pressure. The same applies to the highs and lows of the temperatures. Further, in Embodiment 1, a cooling operation in which the radiator 2 is used as an outdoor heat exchanger and the evaporator 5 is used as an indoor heat exchanger is described. That is, the refrigerant exchanges heat with the outdoor air in the radiator 2, and exchanges heat with the indoor air in the evaporator 5.

First, a low-pressure refrigerant is suctioned into the compressor 1. The low-pressure refrigerant that has been suctioned into the compressor 1 is compressed into a medium-pressure refrigerant (from a state A to a state H). In the middle of a compression stroke of the compressor 1, an intermediate-pressure refrigerant (a state G) is injected from the pipe 15 of the injection circuit so as to be mixed in the compressor 1 (a state I). In the compressor 1, the mixed refrigerant is further compressed into a high-temperature high-pressure refrigerant (from the state I to a state B). The high-temperature high-pressure refrigerant that has been compressed in the compressor 1 is discharged from the compressor 1 and flows into the radiator 2.

The refrigerant that has flowed into the radiator 2 exchanges heat with the outdoor air supplied to the radiator 2 so as to reject heat. Thus, the refrigerant transfers heat to the outdoor air so as to become a low-temperature high-pressure refrigerant (the state B to a state C). This low-temperature high-pressure refrigerant flows out of the radiator 2, and one portion of the refrigerant is subjected to pressure reduction at the second expansion valve 6 so as to become an intermediate-pressure refrigerant, and flows into the internal heat exchanger 3 through the pipe 13. The other one of the diverged portions of the refrigerant that has flowed out of the radiator 2 flows into the internal heat exchanger 3 through the pipe 12 without changing the state thereof. The refrigerants that have flowed into the internal heat exchanger exchange heat with each other. One of the refrigerants is heated (from a state F to a state G), and is injected into the compressor 1. The other one of the refrigerants is cooled (from the state C to a state D), and flows into the first expansion valve 4.

The refrigerant that has flowed into the first expansion valve 4 is subjected to pressure reduction and is turned low in temperature so as to be in a low-quality state (from the state D to a state E). The refrigerant flows out of the first expansion valve 4, evaporates by receiving heat from the indoor air in the evaporator 5 so as to be in a high-quality state while remaining low in pressure (from the state E to a state A). In this way, the indoor air is cooled. The refrigerant that has flowed out of the evaporator 5 is suctioned into the first compressor 1, again. By repeatedly performing the operation described above, the heat of the indoor air is transferred to the outdoor air, so that the room is cooled.

<Controlling Capacity and Flow Rate>

The compressor 1 is a type of compressor in which its capacity is controlled by controlling its rotation speed with an inverter. The cooling capacity is controlled by the rotation speed of the compressor 1. The flow rate of the refrigerant flowing through the evaporator 5 is adjusted by adjusting the opening degree of the first expansion valve 4 on the basis of the degree of superheat at a refrigerant outlet of the evaporator 5. The degree of superheat at the refrigerant outlet of the evaporator 5 is calculated from a saturation temperature of the refrigerant, which is calculated by the controller 50 on the basis of the pressure detected by the pressure sensor 22, and a temperature detected by the temperature sensor 23. If the degree of superheat of the evaporator 5 is too large, the heat-transfer performance in the evaporator 5 is reduced. If the degree of superheat is too small, a large amount of refrigerant liquid flows into the compressor 1, which may result in the compressor 1 becoming damaged. Therefore, the degree of superheat of the evaporator 5 may preferably be in a range of about 2 through 10° C.

<Advantageous Effects of Internal Heat Exchanger>

In the refrigeration cycle apparatus 100, since the refrigerant that has flowed out of the radiator 2 and that is to flow into the first expansion valve 4 is further cooled in the internal heat exchanger 3, even if a refrigerant that enters a supercritical state on the high-pressure side, such as carbon dioxide, is used, it is possible to increase the enthalpy difference of the refrigerant in the evaporator 5. Further, in the refrigeration cycle apparatus 100, the intermediate-pressure refrigerant heated in the internal heat exchanger 3 is injected in the middle of the compression stroke of the compressor 1. Accordingly, in the refrigeration cycle apparatus 100, the refrigerant is cooled at an intermediate pressure in the compressor 1. This makes it possible to prevent the discharge temperature of the compressor 1 from becoming too high, and thus to prevent a large load from being placed on refrigerant oil, a sealing surface, etc.

<Effect of Increasing to High Pressure by Injection>

The refrigeration cycle apparatus 100 can provide the following effect by injecting the refrigerant in the middle of the compression stroke of the compressor 1. The relationship given by the following equation (1) is satisfied:

$$Gdis=Gsuc+Ginj, \quad \text{Equation (1)}$$

where Gsuc represents the flow rate of the refrigerant suctioned into the compressor 1 from the low-pressure side; Ginj represents the flow rate of the injected refrigerant; and Gdis represents the flow rate of the refrigerant discharged from the compressor 1.

Accordingly, the flow rate of the refrigerant entering the radiator 2 is increased by injecting the refrigerant into the compressor 1. Therefore, the amount of heat transfer in the radiator 2 is increased.

<Cooling Operation under Overload Conditions>

A description will be given of a case where the refrigeration cycle apparatus 100 performs a cooling operation under overload conditions. The overload conditions are those where the air temperature is high both inside and outside the room in summer and the like. For example, the overload conditions may be those where the outdoor air temperature is about 45° C. and the indoor air temperature is about 35° C. A cooling operation at such outdoor air temperature and indoor air temperature will be described.

An example of a state of the cooling operation under overload conditions (in the case where injection is not performed) is indicated by a broken line in the P-h diagram of FIG. 4. As shown in the diagram, the high-pressure-side pressure is 11.5 MPa. Since the outdoor air temperature is as high as 45° C., the refrigerant in the radiator 2 cannot be cooled sufficiently, and its temperature increases to as high as about 49° C. Further, when the high-pressure-side pressure enters a supercritical state, in the case where the high-pressure-side pressure is not sufficiently high due to the effects of isotherms, the heat transfer capacity is low, and the enthalpy difference is reduced in the evaporator. On the other hand, in the evaporator 5, since the indoor air temperature is as high as 35° C., the evaporating temperature increases to as high as about 20° C. (the saturation pressure of about 5.5 MPa).

In the case of increasing the enthalpy difference in the evaporator 5 by cooling the refrigerant that flows into the first expansion valve 4 in the internal heat exchanger 3, the following problem occurs. When an intermediate pressure PM is the geometric mean between a high-pressure-side pressure PH and a low-pressure-side pressure PL, the intermediate pressure is given by the following equation (2).

[Formula 1]

$$PM=\sqrt{PH\times PL} \qquad \text{Equation (2)}$$

According to this equation (2), when the high-pressure-side pressure PH is 11.5 MPa and the low-pressure-side pressure PL is 5.5 MPa, the intermediate pressure PM is about 8.0 MPa, which is higher than the critical point pressure of 7.38 MPa.

That is, since the intermediate-pressure refrigerant enters a supercritical state, no latent heat change occurs in the internal heat exchanger 3, and therefore the refrigerant that flows into the first expansion valve 4 cannot be cooled sufficiently. Further, when attempting to control the cooling capacity of the internal heat exchanger 3 by adjusting the opening degree of the second expansion valve 6, since the intermediate-pressure refrigerant enters a supercritical state that has no saturation temperature, it is not possible to detect the saturation temperature of the intermediate-pressure refrigerant on the basis of the temperature of the refrigerant flowing between the second expansion valve 6 and the internal heat exchanger 3 in the pipe 13 or to calculate the degree of superheat on the basis of the temperature difference from the outlet temperature. This makes it difficult to control the cooling capacity.

<Countermeasure>

In order to solve this problem, the refrigeration cycle apparatus 100 is configured to, when operated under overload conditions, inject the intermediate-pressure refrigerant heated by the internal heat exchanger 3 in the middle of the compression stroke of the compressor 1, and divide the radiator 2 so as to reduce the heat transfer area. Thus, the high-pressure-side pressure in the radiator 2 is increased so as to increase the amount of heat transfer and thus increase the cooling capacity.

<Method of Dividing Radiator>

A method of reducing the heat transfer area of the radiator 2 will be described. As mentioned above, the radiator 2 is divided into the first radiator 2*a* and the second radiator 2*b* such that the refrigerant is divided into portions that flow in parallel through the respective first radiator 2*a* and second radiator 2*b*. In the case of reducing the heat transfer area, the solenoid valve 41*a* and the solenoid valve 41*b* are closed such that the refrigerant flows only into the first radiator 2*a*.

<Principle Behind Increase of High-Pressure-Side Pressure>

The principle behind the increase of the high-pressure-side pressure will be described. As mentioned above, when the refrigerant is injected in the middle of the compression stroke of the compressor 1, the flow rate of the refrigerant flowing through the radiator 2 increases, resulting in increase in the amount of heat transfer. In order to increase the amount of heat transfer in the radiator 2, the temperature difference between the refrigerant and air is increased by increasing the high-temperature-side pressure. Thus, the refrigeration cycle is changed so that the enthalpy difference of the refrigerant in the radiator 2 increases. In this case, since the refrigerant outlet temperature cannot be made lower than the air inlet temperature in the radiator 2, the refrigerant outlet temperature is generally dependent on the air inlet temperature. Further, by causing the refrigerant to flow only into the first radiator 2*a*, the heat transfer area is reduced. Thus, since the temperature difference between the refrigerant and air needs to be increased due to the balance of the refrigeration cycle, the high-pressure-side pressure is further increased.

<Advantageous Effect of Combination of Radiator Division and Injection>

However, although the temperature difference between the refrigerant and air is increased by the reduction of the heat transfer area of the radiator 2 and therefore the high-pressure-side pressure is increased, the amount of heat transfer is not significantly increased by that alone and hence the refrigerant enthalpy difference in the radiator 2 cannot be increased. In order to solve this problem, as mentioned above, the refrigerant is injected in the middle of the compression stroke of the compressor 1, whereby the amount of heat transfer can be increased. That is, the refrigeration cycle apparatus 100 is configured to increase the high-pressure-side pressure and thus increase the amount of heat transfer by injection of the refrigerant in the middle of the compression stroke of the compressor 1 and by reduction of the heat transfer area of the radiator 2.

<Principle Behind Increase of Cooling Capacity Due to Increase of High-Pressure-Side Pressure>

When the amount of heat transfer is increased by increasing the high-pressure-side pressure, the following advantageous effects can be obtained. Referring to the P-h diagram of FIG. 4, the refrigerant in the supercritical state has the properties that, on the isotherms, the higher the pressure is, the lower the enthalpy is. In particular, the higher the temperature is, the greater the variation of the enthalpy relative to the pressure is. Further, as mentioned above, the refrigerant outlet temperature in the radiator 2 is dependent on the air inlet temperature. Accordingly, the more the conditions causes the air inlet temperature of the radiator 2, that is, the outdoor air temperature to rise, the more the amount of heat transfer is increased by the increase of the high-pressure-side pressure. Thus, the refrigerant inlet enthalpy of the evaporator 5 decreases, and the refrigerant enthalpy difference in the evaporator 5 increases, making it possible to increase the cooling capacity.

Figure 5:
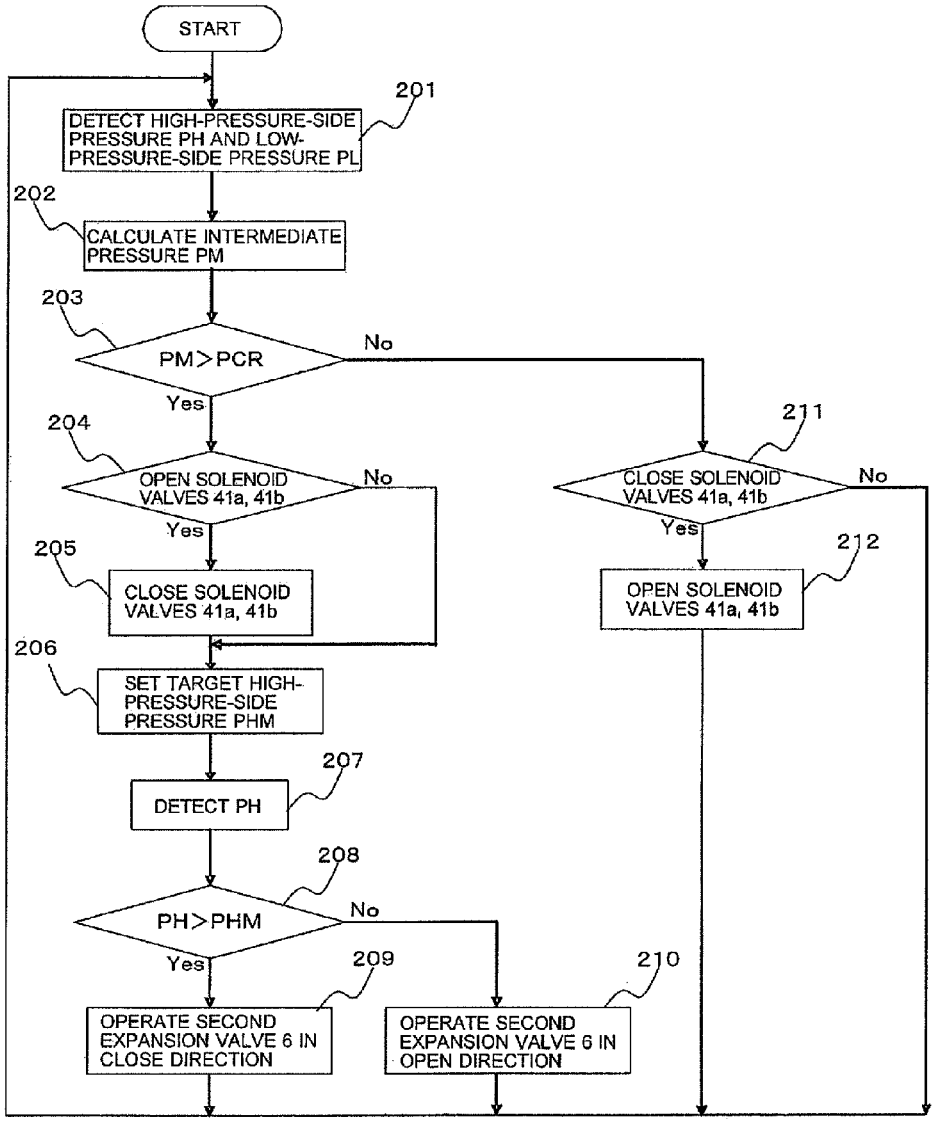
FIG. 5 is a flowchart showing a flow of a specific control process of a second expansion valve and a solenoid valve, which is performed by a controller of the refrigeration cycle apparatus according to Embodiment 1 of the invention.

FIG. 5 is a flowchart showing a flow of a specific control process of the second expansion valve 6, the solenoid valve 41*a*, and the solenoid valve 41*b*, which is performed by the controller 50. Next, a specific method of operating the second expansion valve 6, the solenoid valve 41*a*, and the solenoid valve 41*b* will be described with reference to FIG. 5.

When the refrigeration cycle apparatus 100 performs a cooling operation, the controller 50 detects a high-pressure-side pressure PH on the basis of information from the pressure sensor 21, and detects a low-pressure-side pressure PL on the basis of information from the pressure sensor 22 (Step 201). The controller 50 calculates the intermediate pressure PM from the high-pressure-side pressure PH and the low-pressure-side pressure PL (Step 202). This intermediate pressure PM is calculated from the above equation (2). It should be noted that, from the refrigerant outlet of the second expansion valve 6, another pressure sensor may be provided in the pipe 15 of the injection circuit so as to directly detect the intermediate pressure PM.

The controller 50 determines whether the intermediate pressure PM is higher than a critical point pressure PCR (Step 203). It should be noted that, as mentioned above, the critical point pressure PCR of carbon dioxide is about 7.38 MPa. If the intermediate pressure PM is determined to be higher than the critical point pressure PCR (Step 203; Yes), the controller 50 determines whether the solenoid valve 41*a* and the solenoid valve 41*b* are open (Step 204). If the solenoid valve 41*a* and the solenoid valve 41*b* are open (Step 204; Yes), the controller 50 closes the solenoid valve 41*a* and the solenoid valve 41*b* so as to cause the refrigerant to flow only into the first radiator 2*a* (Step 205). After that, the controller 50 sets a target high-pressure-side pressure PHM (Step 206). This target high-pressure-side pressure PHM will be described below.

After setting the target high-pressure-side pressure PHM, the controller 50 detects the high-pressure-side pressure PH again (step 207). Then, the controller 50 determines whether the high-pressure-side pressure PH is higher than the target high-pressure-side pressure PHM (Step 208). If the high-pressure-side pressure PH is higher than the target high-pressure-side pressure PHM (Step 208; Yes), the controller 50 operates so as to reduce the opening degree of the second expansion valve 6 (Step 209). On the other hand, if the high-pressure-side pressure PH is lower than the target high-pressure-side pressure PHM (Step 208; No), the controller 50 operates so as to increase the opening degree of the second expansion valve 6 (Step 210). After that, the process returns to Step 201.

Meanwhile, if the intermediate pressure PM is determined to be lower than the critical point pressure PCR (Step 203; No), the controller 50 determines whether the solenoid valve 41*a* and the solenoid valve 41*b* are closed (Step 211). If the solenoid valve 41*a* and the solenoid valve 41*b* are closed (Step 211; Yes), the controller 50 opens the solenoid valve 41*a* and the solenoid valve 41*b* so as to allow the refrigerant to flow into the second radiator 2*b* (Step 212). After that, the process returns to Step 201. The controller 50 repeats the above steps so as to perform an operation of increasing the cooling capacity.

<With Regard to High Pressure Target Value and Radiator Division Ratio>

Figure 6:
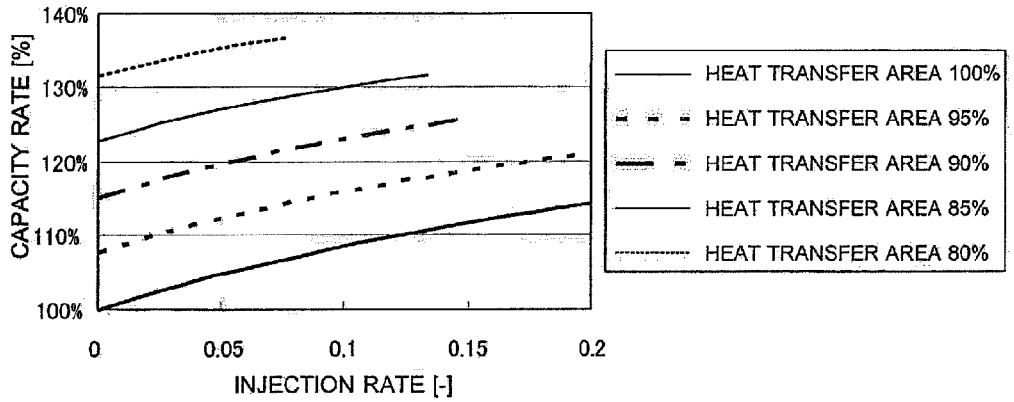
FIG. 6 is a graph showing a relationship between the capacity rate and the heat transfer area of a radiator with respect to the injection rate.
Figure 7:
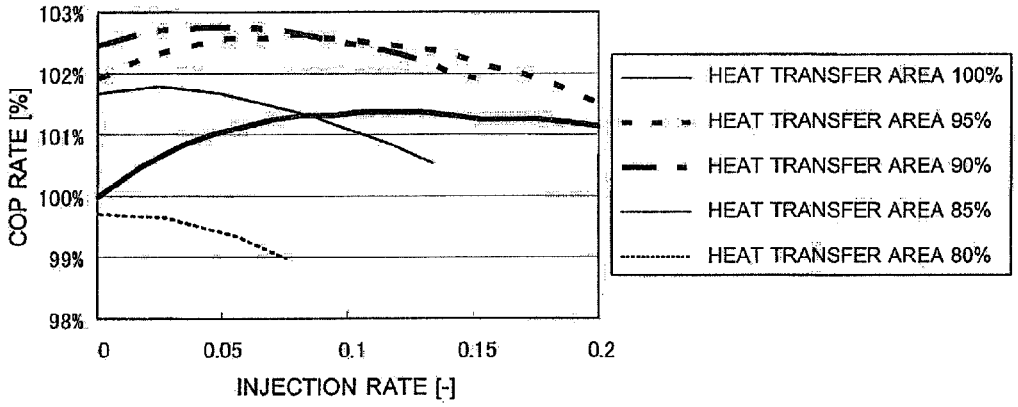
FIG. 7 is a graph showing a relationship between the COP rate and the heat transfer area of the radiator with respect to the injection rate.
Figure 8:
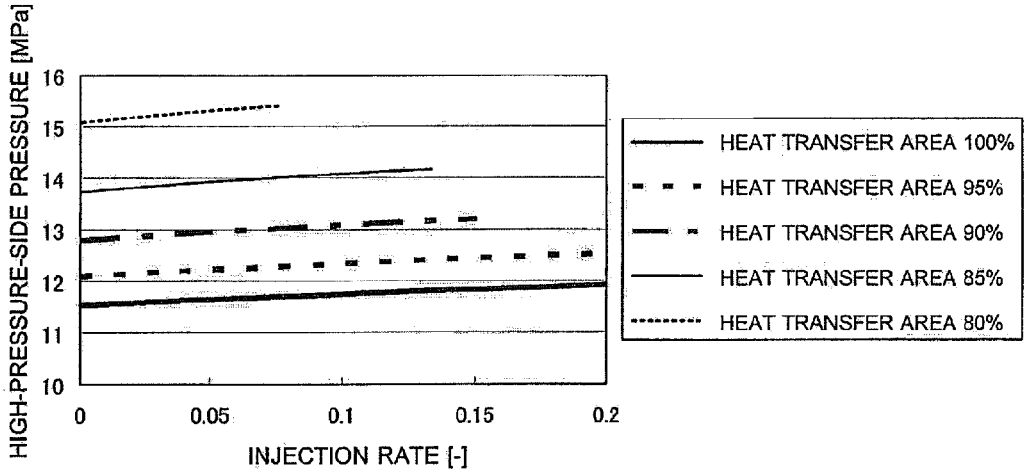
FIG. 8 is a graph showing a relationship between the high-pressure-side pressure and the heat transfer area of the radiator with respect to the injection rate.

The target high-pressure-side pressure PHM will be described herein. FIG. 6 is a graph showing a relationship between the capacity rate and the heat transfer area of a radiator 2 with respect to the injection rate. FIG. 7 is a graph showing a relationship between the COP rate and the heat transfer area of the radiator 2 with respect to the injection rate. FIG. 8 is a graph showing a relationship between the high-pressure-side pressure and the heat transfer area of the radiator 2 with respect to the injection rate. It should be noted that the injection rate is defined as the rate of the flow rate Ginj of the injected refrigerant to the flow rate Gsuc of the refrigerant that is suctioned into the compressor 1 from the low-pressure side. That is, the injection rate is defined as Ginj/Gsuc. Further, the references of the capacity and COP are those obtained in the case where the heat transfer area is set to 100% without dividing the radiator 2 and no injection is performed.

It can be seen from FIG. 6 that the capacity rate increases as the injection rate increases and as the heat transfer area of the radiator 2 decreases. This is because, as can be seen from FIG. 8, the high-pressure-side pressure increases as the injection rate increases and as the heat transfer area of the radiator 2 decreases.

However, it can be seen from FIG. 7 that maximum COP values exist depending on the injection rate and the size of the heat transfer area of the radiator 2. As mentioned above, the cooling capacity increases when the high-pressure-side pressure is increased. However, as can be seen from the isotherms in the P-h diagram, when the high-pressure-side pressure is increased to a certain level, the enthalpy reduction with respect to the pressure increase is reduced. At the same time, since the pressure difference in the compression stroke of the compressor 1 increases and therefore the power required by the compressor 1 increases, the maximum COP value exists.

As mentioned above, there is a suitable high-pressure temperature for increasing the capacity rate without reducing the COP. Since the refrigeration cycle apparatus 100 is especially effective under overload conditions where the indoor air temperature is high, it is necessary to operate the refrigeration cycle apparatus 100 so as to lower the indoor air temperature by increasing the cooling capacity as much as possible. Accordingly, as can be seen from FIGS. 6 through 8, when setting the heat transfer area of the radiator 2 to about 85%, the injection rate to about 0.15, and the high-pressure-side pressure to about 14.2 MPa, compared with the case under operational conditions where the heat transfer area is 100% and the injection rate is 0, since the COP becomes 100%, the COP is not reduced while the cooling capacity is increased by about 35%.

That is, in the refrigeration cycle apparatus 100, it is preferable that the heat transfer area of the first radiator 2*a* be set to about 85% of that of the entire radiator 2, and the target high-pressure-side pressure PHM be set to 14.2 MPa. It should be noted that the above values of the rate of the heat transfer area of the radiator 2 and the target high-pressure-side pressure PHM are especially preferred values, and the values of the rate of the heat transfer area and the target high-pressure-side pressure PHM are not limited to these values.

In the manner described above, the refrigeration cycle apparatus 100 according to Embodiment 1 can increase the cooling capacity under overload conditions where the indoor air temperate is high, and therefore can lower the indoor temperature more quickly.

Further, the above description has illustrated an example in which the control for increasing the cooling capacity involves detecting the high-pressure-side pressure and the low-pressure-side pressure. However, the control for increasing the cooling capacity may be performed on the basis of the inlet air temperature of the radiator 2 detected by the temperature sensor 31 and the inlet air temperature of the evaporator 5 detected by the temperature sensor 32, for example. This is because when the inlet air temperature of the radiator 2 is high, the refrigerant outlet temperature of the radiator 2 naturally becomes high, and the cooling capacity need to be increased. This is also because when the inlet air temperature of the evaporator becomes high, the evaporating temperature of the refrigerant naturally becomes high, and thus there is a relationship between the indoor air temperature and the low-pressure-side pressure.

Further, the above description has illustrated the operation performed when the intermediate pressure becomes a supercritical pressure. However, even if the intermediate pressure is equal to or lower than the critical point pressure, it is possible to reliably increase the cooling capacity by adjusting the opening degree of the second expansion valve 6 in accordance with the target value of the high-pressure-side pressure.

Embodiment 2

While, in Embodiment 1, the cooling capacity is increased when the intermediate pressure is in a supercritical state, in Embodiment 2, the cooling capacity is increased when starting the refrigeration cycle apparatus. The basic configuration and operations of a refrigeration cycle apparatus of Embodiment 2 are the same as those of the refrigeration cycle apparatus 100 of Embodiment 1. It should be noted that Embodiment 2 mainly describes the differences from the above Embodiment 1. In Embodiment 2, the same reference symbols as those used in Embodiment 1 will be used.

Figure 9:
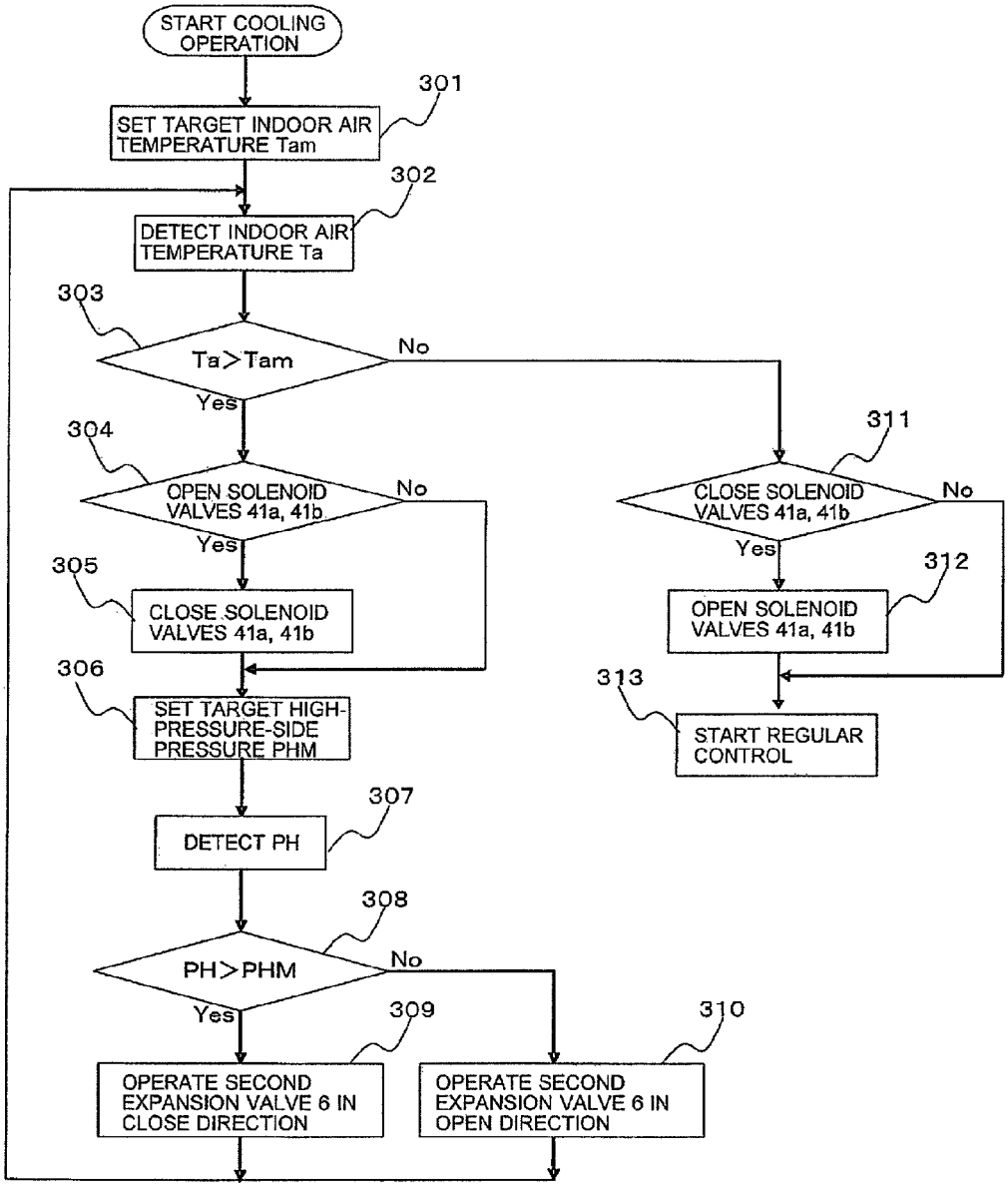
FIG. 9 is a flowchart showing a flow of a specific control process of a second expansion valve and a solenoid valve, which is performed by a controller of the refrigeration cycle apparatus according to Embodiment 2 of the invention.

FIG. 9 is a flowchart showing a flow of a specific control process of the second expansion valve 6, the solenoid valve 41*a*, and the solenoid valve 41*b*, which is performed by the controller 50 of the refrigeration cycle apparatus according to Embodiment 2 of the invention. A specific method of operating the second expansion valve 6, the solenoid valve 41*a*, and the solenoid valve 41*b* will be described with reference to FIG. 9.

When the refrigeration cycle apparatus starts a cooling operation, the controller 50 first sets a target indoor air temperature Tam (Step 301). The target indoor air temperature Tam will be described below.

Then, the controller 50 detects an indoor air temperature Ta on the basis of information from the temperature sensor 32 (Step 302). The controller 50 determines whether the indoor air temperature Ta is higher than the target indoor air temperature Tam (Step 303). If the indoor air temperature Ta is higher than the target indoor air temperature Tam (Step 303; Yes), the controller 50 determines whether the solenoid valve 41*a* and the solenoid valve 41*b* are open (Step 304).

If the solenoid valve 41*a* and the solenoid valve 41*b* are open (Step 304; Yes), the controller 50 closes the solenoid valve 41*a* and the solenoid valve 41*b* so as to cause the refrigerant to flow only into the first radiator 2*a* (Step 305). After that, the controller 50 sets a target high-pressure-side pressure PHM (Step 306).

After setting the target high-pressure-side pressure PHM, the controller 50 detects the high-pressure-side pressure PH (step 307). Then, the controller 50 determines whether the high-pressure-side pressure PH is higher than the target high-pressure-side pressure PHM (Step 308). If the high-pressure-side pressure PH is higher than the target high-pressure-side pressure PHM (Step 308; Yes), the controller 50 operates so as to reduce the opening degree of the second expansion valve 6 (Step 309). On the other hand, if the high-pressure-side pressure PH is lower than the target high-pressure-side pressure PHM (Step 308; No), the controller 50 operates so as to increase the opening degree of the second expansion valve 6 (Step 310). After that, the process returns to Step 302.

Meanwhile, if the indoor air temperature Ta is determined to be lower than the target indoor air temperature Tam (Step 303; No), the controller 50 determines whether the solenoid valve 41*a* and the solenoid valve 41*b* are closed (Step 311). If the solenoid valve 41*a* and the solenoid valve 41*b* are closed (Step 311; Yes), the controller 50 opens the solenoid valve 41*a* and the solenoid valve 41*b* so as to allow the refrigerant to flow into the second radiator 2*b* (Step 312). After that, the process switches to regular control (Step 313). The term "regular control" as used herein indicates a usual cooling operation that is performed in accordance with a command from the controller 50. The target indoor air temperature Tam described above may be 27° C., which is a standard indoor air temperature in a cooling operation, for example.

In the manner described above, the refrigeration cycle apparatus according to Embodiment 2 can increase the cooling capacity by increasing the high-pressure-side pressure when the indoor temperature is higher than a standard indoor air temperature in a cooling operation, and therefore can lower the indoor air temperature more quickly. This makes it possible to provide users with a higher level of comfort.

It should be noted that, in the refrigeration cycle apparatus according to Embodiment 2, the target high-pressure-side pressure PHM, the percentage of the heat transfer area of the first radiator 2*a* to the heat transfer area of the entire radiator 2, etc., may be determined in the same manner described in Embodiment 1. Further, the refrigeration cycle apparatus according to Embodiment 2 is configured such that, if the indoor air temperature becomes lower than the target indoor air temperature in Step 303, the process switches to regular control in Step 313. Accordingly, this prevents the indoor air from being excessively cooled due to an excessively increased high-pressure-side pressure, and prevents electric power from being wasted.

It should be noted that, although the refrigeration cycle apparatuses according to Embodiment 1 and Embodiment 2 detect the low-pressure-side pressure 22 provided at the refrigerant outlet of the evaporator 5, a temperature sensor may separately be provided between the refrigerant outlet of the first expansion valve 4 and the refrigerant inlet of the evaporator 5 in place of the pressure sensor 22 so as to calculate the low-pressure-side pressure from a saturation temperature detected by this temperature sensor.

Since the refrigeration cycle apparatuses according to Embodiment 1 and Embodiment 2 adjust the opening degree of the second expansion valve 6 in accordance with the target value of the high-pressure-side pressure, even under conditions, such as overload condition, where the intermediate pressure enters a supercritical state and hence the saturation temperature cannot be calculated, it is possible to reliably increase the cooling capacity.

Further, while only the operations performed by the refrigeration cycle apparatus during a cooling operation are described in Embodiment 1 and Embodiment 2, a four-way valve or the like for switching between the refrigerant passages may be provided, for example, such that a heating operation is executable in which the radiator 2 heats the indoor air. In the case where a heating operation is executable, the heating capacity can be increased by performing the operational actions described in Embodiment 1 and Embodiment 2.

In Embodiment 1 and Embodiment 2, two-way valves, that is, the solenoid valve 41*a* and the solenoid valve 41*b* are provided in order to block the refrigerant from flowing through the second radiator 2*b*. However, the invention is not limited to these embodiments, and any means for blocking the refrigerant can be used. For example, a check valve may be provided at the refrigerant outlet side of the second radiator 2*b*.

Further, in Embodiment 1 and Embodiment 2, the radiator 2 and the evaporator 5 serve as heat exchangers that exchange heat between a refrigerant and air. However, the invention is not limited to these embodiments. For example, the radiator 2 and the evaporator 5 may be heat exchangers that exchange heat between a refrigerant and a heat medium other than air, such as and brine.

In Embodiment 1 and Embodiment 2, the high-pressure-side pressure is increased by performing an injection into the compressor 1 and by reducing the heat transfer area of the radiator 2. However, the invention is not limited to these embodiments. In place of reducing the heat transfer area of the radiator 2, the air volume of a fan (not shown) that forces the air to pass over the outer surface of the radiator 2 may be reduced, or the flow rate of a pump (not shown) that circulates another heat medium such as water and brine may be reduced. These configurations can also increase the pressure of the radiator 2.

Further, in Embodiment 1 and Embodiment 2, the refrigerant of an intermediate pressure is injected into the compression chamber 108 of the compressor 1. However, the compressor 1 may have a two-stage compression mechanism, and the refrigerant may be injected into a path connecting between a low-stage compression chamber and a high-stage compression chamber. Further, the compressor 1 may include a plurality of compressors so as to perform two-stage compression.

REFERENCE SIGNS LIST

1 compressor; 2 radiator; 2*a* first radiator; 2*b* second radiator; 3 internal heat exchanger; 4 first expansion valve; 5 evaporator; 6 second expansion valve; 11 pipe; 12 pipe; 13 pipe; 14 pipe; 15 pipe; 16 discharge pipe; 21 pressure sensor; 22 pressure sensor; 23 temperature sensor; 31 temperature sensor; 32 temperature sensor; 41*a* solenoid valve; 41*b* solenoid valve; 50 controller; 100 refrigeration cycle apparatus; 101 shell; 102 electric motor; 103 drive shaft; 104 oscillating scroll; 105 fixed scroll; 106 inflow pipe; 107 low-pressure space; 108 compression chamber; 109 compression chamber; 110 outflow port; 111 high-pressure space; 112 outflow pipe; 113 injection port; and 114 injection pipe.

The invention claimed is:

1. A refrigeration cycle apparatus comprising:

a main refrigerant circuit in which a compressor that compresses a refrigerant, a radiator that rejects heat of the refrigerant compressed by the compressor, a primary passage of an internal heat exchanger that exchanges heat between the refrigerant which has passed through the radiator and refrigerant which has passed through the radiator and is to be injected into the compressor, a first pressure reducing device that reduces a pressure of the refrigerant which has passed through the primary passage of the internal heat exchanger, and an evaporator where the refrigerant that has been subjected to pressure reduction by the first pressure reducing device evaporates are sequentially connected to one another by pipes;

an injection circuit in which a second pressure reducing device that reduces a pressure of the refrigerant which has passed through the radiator and is to be injected into the compressor, a secondary passage of the internal heat exchanger, and an injection port of the compressor are sequentially connected to one another by pipes; and a controller that controls an opening degree of the second pressure reducing device and a heat transfer area of the radiator, wherein the high-pressure-side pressure of the refrigerant flowing through the main refrigerant circuit enters a supercritical state, and the controller simultaneously adjusts the opening degree of the second pressure reducing device and reduces the heat transfer area of the radiator so as to increase a high-pressure-side pressure if the operation state is under an overload condition in which both outside and inside air temperatures are high enough to be indicative of overloading.

2. The refrigeration cycle apparatus of claim 1, wherein the radiator is divided into a plurality of units so as to form parallel flows of the refrigerant in the radiator; and wherein the controller increases the high-pressure-side pressure by allowing or blocking passage of the refrigerant through one or some of the divided units of the radiator and thereby decreasing the heat transfer area of the radiator.

3. The refrigeration cycle apparatus of claim 2, further comprising:

an opening and closing device that allows or blocks passage of the refrigerant at each inlet and/or outlet of one or some of the divided units of the radiator, wherein the controller reduces the heat transfer area of the radiator by controlling opening and closing of the opening and closing device.

4. The refrigeration cycle apparatus of claim 3, wherein the opening and closing device includes a solenoid valve.

5. The refrigeration cycle apparatus of claim 3, wherein the opening and closing device includes a solenoid valve and a check valve.

6. The refrigeration cycle apparatus of claim 1, further comprising:

first pressure detecting means for detecting the high-pressure-side pressure of the refrigerant flowing from a discharge part of the compressor to an inlet of the first pressure reducing device, and second pressure detecting means for detecting a low-pressure-side pressure of the refrigerant flowing between an outlet of the first pressure reducing device and a suction part of the compressor, wherein the controller calculates an intermediate pressure on the basis of the high-pressure-side pressure detected by the first pressure detecting means and the low-pressure-side pressure detected by the second pressure detecting means and determines that the operation state is under the overload condition if the intermediate pressure is higher than a critical pressure of the refrigerant.

7. The refrigeration cycle apparatus of claim 6, wherein the controller reduces the high-pressure-side pressure of the refrigerant flowing through the main refrigerant circuit by reducing the opening degree of the second pressure reducing device if the high-pressure-side pressure detected by the first pressure detecting means is higher than a predetermined value, and increases the high-pressure-side pressure of the refrigerant flowing through the main refrigerant circuit by increasing the opening degree of the second pressure reducing device if the high-pressure-side pressure is lower than the predetermined value.

8. The refrigeration cycle apparatus of claim 1, wherein the controller detects an intermediate pressure of the refrigerant flowing from an outlet of the second pressure reducing device to an injection port of the compressor, and determines that the operation state is under the overload condition, if the intermediate pressure is higher than a critical pressure of the refrigerant.

9. The refrigeration cycle apparatus of claim 1, further comprising:

first temperature detecting means for detecting an inlet air temperature of the radiator; and second temperature detecting means for detecting an inlet air temperature of the evaporator, wherein the controller determines that the operation state is under the overload condition if the temperature detected by the first temperature detecting means and the temperature detected by the second temperature detecting means are higher than predetermined temperatures.

10. The refrigeration cycle device of claim 1, wherein upon starting a cooling operation, the controller determines that the operation state is under the overload condition if an inlet air temperature of the evaporator is higher than a predetermined temperature.

11. The refrigeration cycle apparatus of claim 1, further comprising:

a fan that forces air to pass through the radiator, wherein the controller increases the high-pressure-side pressure of the refrigerant flowing through the main refrigerant circuit by also changing a rotational speed of the fan.

12. The refrigeration cycle apparatus of claim 1, further comprising:

a circulating device that passes a heat medium through the radiator, wherein the controller increases the high-pressure-side pressure of the refrigerant flowing through the main refrigerant circuit by also changing a rotational speed of the circulating device.

13. A refrigeration cycle apparatus comprising:

a main refrigerant circuit in which a compressor that compresses a refrigerant, a radiator that rejects heat of the refrigerant compressed by the compressor, a primary passage of an internal heat exchanger that exchanges heat between the refrigerant which has passed through the radiator and refrigerant which has passed through the radiator and is to be injected into the compressor, a first pressure reducing device that reduces a pressure of the refrigerant which has passed through the primary passage of the internal heat exchanger, and an evaporator where the refrigerant that has been subjected to pressure reduction by the first pressure reducing device evaporates, are sequentially connected to one another by pipes;

an injection circuit in which a second pressure reducing device that reduces a pressure of the refrigerant which has passed through the radiator and is to be injected into the compressor, a secondary passage of the internal heat exchanger, and an injection port of the compressor are sequentially connected to one another by pipes;

a controller that controls an opening degree of the second pressure reducing device and a heat transfer area of the radiator;

first pressure detecting means for detecting the high-pressure-side pressure of the refrigerant flowing from a discharge part of the compressor to an inlet of the first pressure reducing device, and second pressure detecting means for detecting a low-pressure-side pressure of the refrigerant flowing between an outlet of the first pressure reducing device and a suction part of the compressor, wherein the high-pressure-side pressure of the refrigerant flowing through the main refrigerant circuit enters a supercritical state, the controller simultaneously adjusts the opening degree of the second pressure reducing device and reduces the heat transfer area of the radiator so as to increase a high-pressure-side pressure if the operation state is under an overload condition in which both outside and inside air temperatures are high enough to be indicative of overloading, and the controller calculates an intermediate pressure on the basis of the high-pressure-side pressure detected by the first pressure detecting means and the low-pressure-side pressure detected by the second pressure detecting means, and determines that the operation state is under the overload condition if the intermediate pressure is higher than a critical pressure of the refrigerant.

* * * * *